US006964537B1

(12) United States Patent
Ong

(10) Patent No.: US 6,964,537 B1
(45) Date of Patent: Nov. 15, 2005

(54) SINGLE SHEET REPORT COVER WITH SLIDE BAR

(76) Inventor: Bon S. Ong, Box 4247, Torrance, CA (US) 90510

( * ) Notice: Subject to any disclaimer, the term of this patent is extended or adjusted under 35 U.S.C. 154(b) by 56 days.

(21) Appl. No.: 10/750,726

(22) Filed: Jan. 5, 2004

(51) Int. Cl.[7] ..... B42F 13/06

(52) U.S. Cl. ..... 402/14; 24/67 R; 281/21.1; 402/73; 402/80 R

(58) Field of Search ..... 281/15.1, 21.1, 281/28, 29, 36–38; 24/67 R; 402/14, 17, 402/18, 73, 74, 79, 80 P, 80 R

(56) References Cited

U.S. PATENT DOCUMENTS 5,727,816 A * 3/1998 Ong ..... 281/29
5,865,469 A 2/1999 Chin
5,947,524 A * 9/1999 Podosek ..... 281/45
D447,171 S * 8/2001 Wolff et al. ..... D19/32
6,270,120 B1 8/2001 Ong
6,371,520 B1 * 4/2002 Wolff et al. ..... 281/29
6,663,311 B1 12/2003 Ong

* cited by examiner

*Primary Examiner*—Monica S. Carter
(74) *Attorney, Agent, or Firm*—Charles H. Thomas

(57) ABSTRACT

A single sheet report cover is folded to create a top cover sheet, a bottom cover sheet, a narrow binding margin panel extending a short distance from a spine fold, and a return panel folded under the binding margin panel at a return fold. An elongated document binder clasp is provided with a pair of mutually facing jaws that define a gap therebetween. At least one of the jaws has a hooked lip. The document binder clasp is pressed on to the portion of the document binder covering the binding margin of a stack of papers encased therewithin. The hooked lip of one of the jaws of the clasp engages the return fold and the resilient clamping force of the jaws is sufficient to prevent either the document binder or the sheets held between the top and bottom covers formed by the binder from being pulled away from the clasp.

9 Claims, 2 Drawing Sheets

SINGLE SHEET REPORT COVER WITH SLIDE BAR

BACKGROUND OF THE INVENTION

1. Field of the Invention

The present invention relates to a locking slide bar or clasp of the type used to form a stiff spine for reports, presentations, and other stacks of paper assembled and bound together.

2. Description of the Prior Art

Plastic spines or slide bars for use in gripping the binding edges of stacks of papers together, such as reports, proposals, briefs, and other stacks of documents fastened together along a common edge have been manufactured for many years. Conventional report cover grips or slide bars of this type are manufactured as extruded plastic structures of uniform cross section throughout. Conventional slide grips are formed with a pair of jaws joined together at a common base and forming an open slot or gap therebetween. The jaws are laterally elongated so as to extend the entire length of the binding edge of the stack of papers. The gap between the jaws is narrow enough so that they must be forced apart slightly to accommodate the thickness of the stack of papers to be gripped therebetween. The jaws can be deflected resiliently apart to increase the width of the gap therebetween so as to receive the binding edge of the stack of papers within the gap. When the jaws are released, a clamping force is exerted by the jaws against the stack of papers as the jaws attempt to move toward each other back toward their undeformed positions.

A major problem with conventional slide grips or slide bars of this type is that the gripping force is inadequate to secure the grip on the binding edge of the stack of papers. Quite often when a user opens the report the stress of parting the papers as the covers are opened is transmitted to the slide grip as a force directed outwardly away from the binding edge of the report in a direction perpendicular thereto. As a consequence, the slide grip is pushed laterally away from the binding edge of the report and pops off of the binding edge of the report. This tendency is aggravated when the report has a clear, slick, glossy cover, such as a clear plastic polypropylene cover of the type frequently used as a report or presentation cover to protect the papers therewithin. The low coefficient of friction on the surface of such a plastic cover makes it extremely easy for a conventional spine gripping bar to pop off of the binding edge of a stack of bound papers.

Attempts have been made to correct this problem. For example, the otherwise conventional sliding bar report cover grip sold by the JM Company located in Hasbrouck Heights, N.J. has a report cover gripping bar provided with a pair of opposing longitudinal ribs directed toward each other near the bases of the jaws of the grip. The concept is that the additional contact with the cover provided by the ribs will enhance the gripping force provided by the slide bar on the cover. However, this system provides no positive interlocking connection between the slide bar and the report cover so that the report cover grip still slides free from the cover when the report is opened.

The Avery Dennison Company has used a gripping report cover slide bar on which the extremities of the jaws are provided with inwardly directed hooks or tangs. A polyethylene plastic report cover is folded in half and die cut near its longitudinal center fold with a plurality of arcuate, semicircular die cuts spaced periodically along its length to create a number of tabs. The curved surfaces of the semicircular tabs are directed away from the binding center fold and toward the opposite edges of the cover and of the stack of papers encompassed therewithin. However, this system still has several problems. Because the semicircular tabs lie in the same plane as the cover sheet material from which they are cut, the hooked edges of the gripping bar will sometimes fail to engage the semicircular tabs. Also, the die cuts are through both the front and back cover of the folded polyethylene cover sheet and must be spaced quite closely to the center fold line in order to be engaged by the hooks or tangs at the extremities of the jaws of the gripping bar. There is very little structure left between the front and back die cuts adjacent the spine fold line. As a consequence, the material forming the front and back covers can fail at the fold line and the tabs will separate from the remaining structure of the cover as generally circular die cut punch outs.

I previously devised a locking slide bar system that avoided the disadvantages of the prior art structures described. My prior system is described in U.S. Pat. No. 6,270,120 issued Aug. 7, 2001, which is hereby incorporated by reference in its entirety.

According to this prior system a document binder was formed from two sheets of flat, expansive material, one of which formed a top cover for a stack of papers, and the other of which was folded to form a plurality of articulated panels including a back panel, and a narrow margin panel with a width no greater than the width of the binding margin of the stack of papers. In a preferred embodiment a return panel was also formed from the same sheet of material defining the bottom panel and the margin panel. The margin panel, the top panel and the back panel and the stack of papers located therebetween were all secured together by a conventional fastener system, such as one or more staples. The return panel was then folded back atop the margin panel. A locking slide bar was utilized in such a manner as to engage the folded delineation between the binding margin panel and the return panel with a positive locking interengagement of the narrow binding margin panel in the hooked lip of one of the jaws of the locking slide bar.

Well this system works quite well, it does require the document binder to be formed of a plurality of flat, expansive sheets of material. Also, it requires the use of fasteners to secure the papers in the stack together and to the binding margin panel and the bottom panel between which the sheets of paper are captured.

SUMMARY OF THE INVENTION

I have now devised an improvement of this prior system that allows the document binder to be formed of a single sheet of flat expansive material folded to delineate a bottom panel, a binding margin panel, a return panel, and a top cover panel. It is possible to form all four of these panels from a single sheet of stock by reversing the locations of the binding margin panel and the return panel. That is, while in the prior system the return panel was folded back atop the binding margin panel, in the improved system of the present invention the return panel is folded back underneath the binding margin panel. A further fold in the same sheet of material proximate the binding edge of the stack of papers delineates the return panel from the top cover panel. As a consequence, all the necessary panels of the document binder can be formed by folding a single sheet of material.

The present invention is advantageous because it has a document binder formed from a single sheet of material. This reduces the cost of document binder fabrication since the document binder is constructed in one piece.

Furthermore, the improved system of the present invention requires no auxiliary fasteners, such as staples, pronged fasteners, or other equivalent fastening systems in order to immobilize the papers in the stack of papers at the binding margin thereof. To the contrary, at least one of the jaws of the locking slide bar is configured with a hooked lip that engages the return fold that forms the demarcation between the binding margin panel and the return panel. Moreover, the jaws of the locking slide bar are configured with sufficient stiffness and with a narrow enough gap therebetween so that the jaws not only engage the cover, but also clamp the stack of papers together. As a consequence, the additional step of stapling the papers and report cover together is avoided. Indeed, the stack of papers can be firmly held at the binding margin of the stack by the clamping action of the jaws.

In one broad aspect the present invention may be considered to be the combination, of a plurality of sheets of paper disposed one atop another to form a stack, a document binder formed of a single sheet of flat, expansive material, and a stiff, resilient, elongated channel-shaped clasp. The stack of papers has top and bottom sheets and defines a binding edge of the stack, an opposite edge of the stack parallel to the binding edge, and a narrow binding margin on the stack adjacent to the binding edge. The sheet of material forming the document binder is folded to delineate a plurality of panels including a back binding panel located beneath the entire stack and extending beneath the binding margin, a narrow binding panel joined to the back binding panel, typically by a spine fold, and residing above the stack and the narrow binding margin thereof and having a width no greater than the width of the binding margin. The document binder is further folded to form a binding return panel joined to the narrow binding panel at a return fold and located beneath the narrow binding panel and projecting from the return fold back toward said binding edge of said stack. The document binder sheet is folded further to form a top binding panel located atop the stack above the top sheet thereof and extending from the proximity of the binding edge of the stack across the top sheet to at least the opposite edge of said stack.

The clasp has a uniform cross section throughout and is formed with a pair of jaws joined together and projecting outwardly from their junction to define a gap therebetween. At least one of the jaws terminates in a hooked lip. The binding edge of the stack is inserted into the gap between the jaws so that the hooked lip is engaged with the document binder at the return fold therein to restrict relative movement between the clasp and the stack in a direction perpendicular to the binding edge. The clasp has sufficient stiffness so that the jaws clamp the sheets of paper together between the top and back binding panels of the document binder.

Preferably, each of the jaws of the clasp terminates in a hooked lip of the type described. Preferably also the binding return panel is secured to the top binding panel in face-to-face relationship there with between the return fold and the spine fold. The top panel and the return panel are preferably secured together throughout the width of the binding margin in the stack by a layer of adhesive interposed therebetween.

In another broad aspect the invention may be considered to be a combination of a plurality of pages disposed one atop another to form a stack, a binding for the stack formed of a single, expansive sheet of material, and a stiff, resilient elongated clasp having a pair of opposing jaws which define a slot opening therebetween. The stack has top and bottom sheets. The stack also defines a binding edge and an opposite edge parallel to the binding edge, and a narrow binding margin on the stack adjacent to the binding edge. The binding includes top and bottom face panels respectively overlying the top and bottom sheets of the stack. The top and bottom face panels are joined together by at least one spine fold located at and parallel to the binding edge of the stack. The binding also defines a narrow margin panel that is joined to the bottom face panel and extends the length of the binding margin. The narrow margin panel is limited in width so that the extends no further toward the opposite edge of the stack than the binding margin. The narrow margin panel thereby defines an inboard boundary proximate the binding margin.

The binding further defines a return panel residing between the narrow margin panel and the top face panel. The return panel is joined to the narrow margin panel by a return fold located at the inboard boundary. The return panel is joined to the top face panel by a binding edge fold located proximate the binding edge of the stack.

The clasp is formed as a channel shaped structure and its jaws have mutually facing surfaces. At least one of the jaws terminates in an inwardly turned hooked lip. The clasp is disposed to capture the binding therewithin. The hooked lip of one of the jaws of the clasp engages the return fold in the binding at the inboard boundary of the narrow margin panel. The engaged hooked lip of the clasp thereby holds the clasp on the binding edge of the stack. The jaws are biased toward each other with sufficient force to clamp the plurality of pages together without the necessity of any binding margin fastener.

In still another broad aspect the invention may be defined as the combination of a plurality of sheets of paper disposed one atop another to form a stack, a document binder formed of a single sheet of flat material folded to delineate a plurality of panels, and an elongated document binder clasp configured as a stiff but resilient channel shaped structure defining a pair of mutually facing jaws that define a gap therebetween.

The stack has top and bottom sheets. The stack has a binding edge, an opposite edge parallel to the binding edge, and a narrow binding margin adjacent to the binding edge. The document binder includes a top binding panel located atop the stack and extending from the opposite edge of the stack across the binding margin to terminate at a binding margin fold. The document binder also has a narrow return panel extending from the binding margin fold back across the binding margin. The return panel terminates at a return fold. The document binder also defines a narrow binding margin panel located atop the return panel and covering the return panel. The narrow binding margin panel extends beyond the binding edge of the stack and terminates at a spine fold. The document binder further includes a back binding panel joined to the binding margin panel by the spine fold so as to extend the meet the stack. The stack is located between the top and bottom binder panels.

The document binder clasp is configured as a stiff, resilient, channel shaped structure defining a pair of mutually facing jaws that define a gap therebetween. At least one of the jaws has a hooked lip. The binder clasp clamps the plurality of sheets of paper in the stack together at the binding edge margin of the stack. The hooked lip of one of the clasp jaws engages the binder at the return fold throughout the length of the binding margin.

The invention may be described with greater clarity and particularity by reference to the accompanying drawings.

DESCRIPTION OF THE EMBODIMENT

Figure 1:
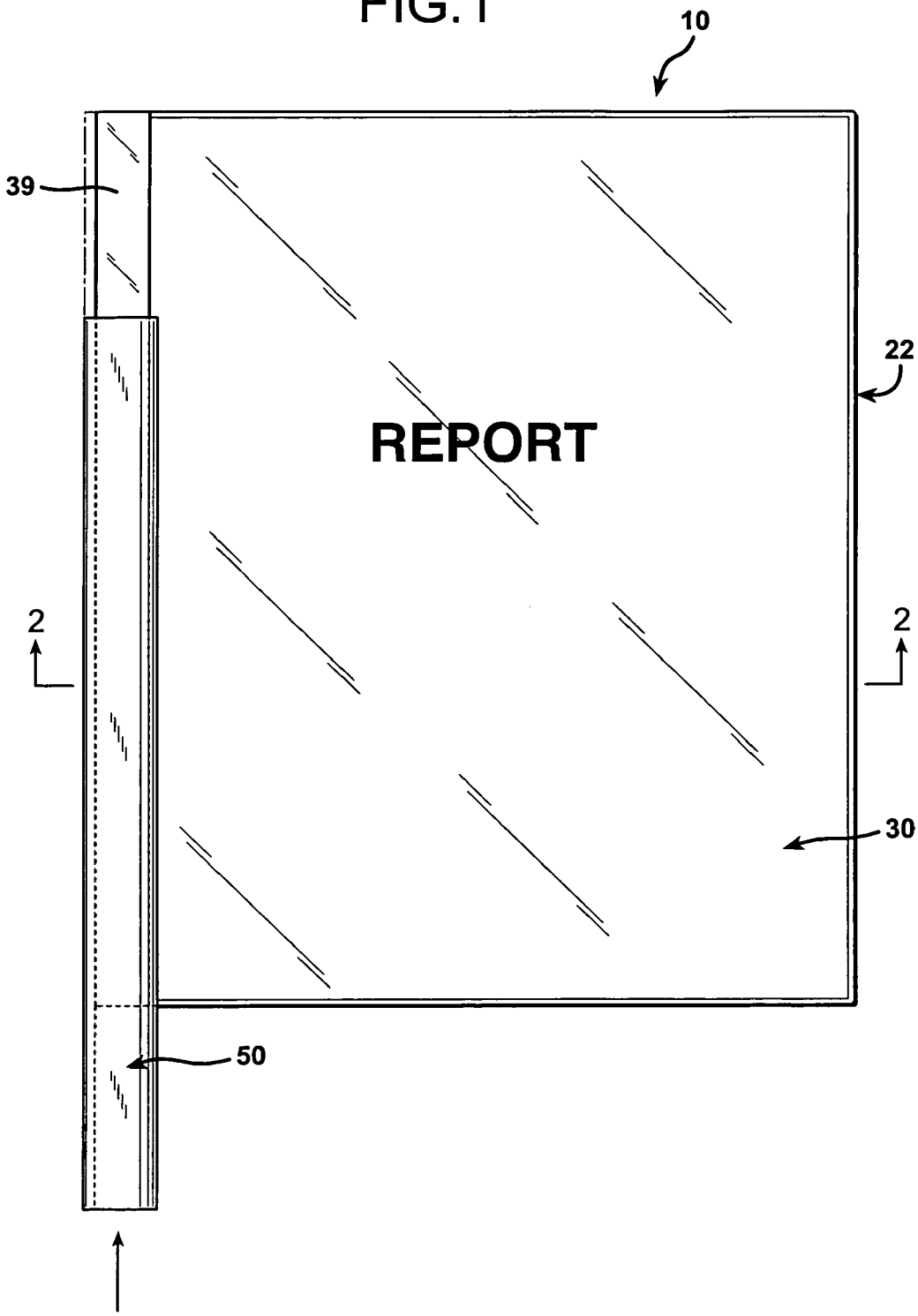
FIG. 1 is a top plan view of a report having a document binder configured according to the present invention and employing a locking slide bar which is attached to the report cover as shown.
Figure 2:
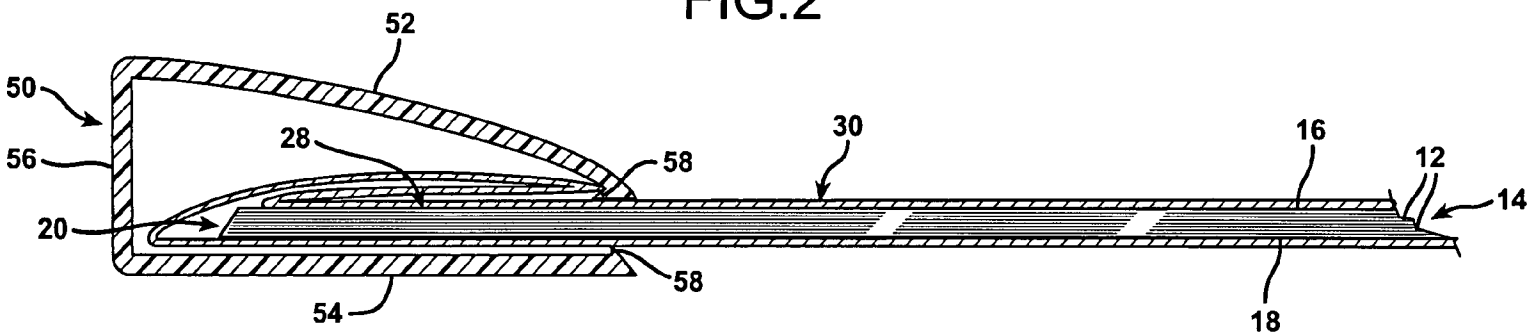
FIG. 2 is a sectional view taken along the lines 2—2 of FIG. 1.

FIGS. 1 and 2 illustrate the combination of the invention generally at 10. The combination 10 is comprised of a plurality of rectangular sheets of paper 12 disposed one atop another to form a stack of papers indicated generally at 14. The paper sheets 12 may have, for example, a width of eight and one-half inches and a length of eleven inches. The paper stack 14 has a top sheet 16 and a bottom sheet 18. The stack of papers 14 defines a binding edge indicated at 20 and an opposite edge 22 which is parallel to the binding edge 20. The paper stack 14 also has an upper edge and an opposite lower edge. The stack 14 also defines a narrow binding margin 28 which may, for example, be between about one and about one-half an inch in width. The binding margin 28 is adjacent to the binding edge 20 of the stack 14.

The combination 10 also includes a document binder 30 which may be formed of polypropylene, heavy paper or card stock. The binder 30 is formed of a single sheet of flat material folded to delineate a plurality of panels including a top binding panel 32 located atop the stack 14 and extending from the opposite edge 22 of the stack 14 across the binding margin 28 to terminate at a binding a margin fold 24. The top cover binding panel 32 is located atop the top sheet 16 of the stack 14 and resides in contact with the binding margin 28 of the stack 14.

Figure 3:
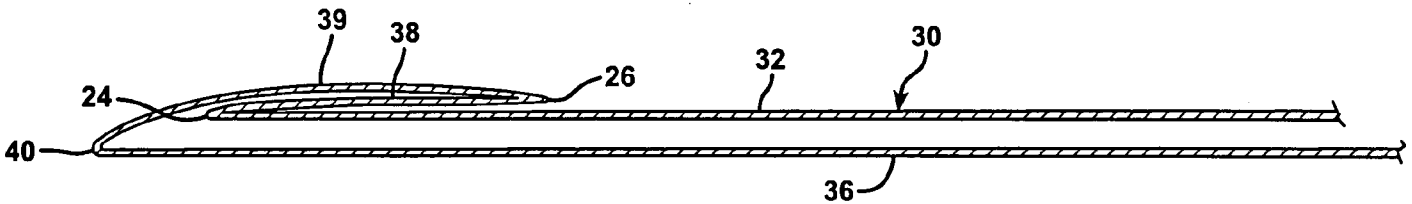
FIG. 3 is an end view of one embodiment of a document binder employed in the present invention, shown in isolation.

The document binder 30 also defines a narrow return panel 38 extending from the binding margin fold 24 across the binding margin 28. The narrow return panel 38 terminates at a return fold 26. The document binder 30 also defines a narrow binding margin panel 39 located atop the return panel 38 and covering the return panel 38. The narrow binding margin panel 39 extends beyond the binding edge 20 of the stack 14 and terminates at a spine fold 40. From the spine fold 40 the document binder 30 forms a broad bottom cover binding panel 36 that extends from the spine fold 40 across the stack 14 all the way across to the opposite edge 22 of the stack 14 underneath the bottom sheet 18 of the stack of papers 14. The binder 30 envelopes the entire paper stack 14 throughout its length. The document binder 30 is illustrated in isolation in FIG. 3.

The binding margin panel 39 is limited in width so that it extends no further toward the opposite edge 22 of the stack 14 than the binding margin 28. The inboard boundary of the top binding margin panel 39 formed by the longitudinal fold 26 is located proximate the binding margin 28 of the stack 14 and only about one to one-half an inch from the binding edge 20 of the stack 14.

The combination 10 also employs a stiff, resilient, elongated channel shaped document binder clasp 50 which may be formed as an extrusion of polyvinyl chloride or another plastic which is cut to length. The clasp 50 is configured with a pair of opposing jaws 52 and 54 that are joined together at their respective bases by a spine section 56. The spine section 56 spans the distance between the top sheet 16 and the bottom sheet 18 of the stack of papers 14. The jaws 52 and 54 project outwardly from the spine section 56 and both terminate in hooked lips 58 which face each other across the slot opening defined between the jaws 52 and 54, as illustrated in FIG. 2. The tip of each hooked lip 58 is turned back and points toward the spine section 56.

FIG. 1 illustrates the manner of assembly of the clasp 50 with the report in which the document binder 30 envelopes the stack of papers 14 to create the combination 10. The clasp 50 is positioned near either the top edge or the bottom edge of the document binder 30, which has already been folded into the panels previously described. The clasp 50 encases the stack of papers 14 between the top cover binding panel 32 and the bottom cover binding panel 36.

The jaws 52 and 54 of the clasp 50 are then flexed slightly apart adjacent the end of the stack 14 at which the clasp 50 is to be inserted over the cover 30. The clasp 50 is then pushed along the binding edge 20 of the stack 14 located within the document binder 30, whereupon the folded-under return panel 38 and the binding margin panel 39 above are both engaged at the return fold 26 in the crevice formed at the hooked lip 58 of the upper jaw 52, as illustrated in FIG. 2.

The clasp 50 is then pushed all the way along the length of the stack 14 so that the ends of the clasp 50 are in registration with the top and bottom edges of the document binder 30. When assembled in this manner the clasp 50 is firmly engaged with the document cover 30 by virtue of the positive, interlocking, interengagement of the demarcation edge 26 at the upper side of the document binder 30 in the crevice within the lip 58 of the upper jaw 52 of the clasp 50. As is evident from FIG. 2, the clasp 50 will resist separation from the stack 14 even though a significant lateral or transverse force of separation is applied against the clasp 50 toward the opposite edge 22 of the stack of papers 14 and perpendicular to the binding edge 20 of the stack 14 due to the engagement of the return fold 26 with the lip 58 of the clasp jaw 52.

The clamping force of the jaws 52 and 54 and the engagement of the return fold 26 by the hooked lip 58 of the jaw 52 provides a sufficient force to prevent either the document binder 30 or the stack of papers 14 held therewithin from being pulled laterally out of the clasp 50. By employing a double thickness with the return panel 38 and binding margin panel 39 joined at the return fold 26, a positive latching engagement is created between one of the clasp jaws and the narrow layers of the document binder 30 formed at the binding margin of the stack of papers 14. The material forming the document binder 30 is normally stiff enough so that a lateral force will not unfold the return panel 38 from the margin panel 39.

Figure 4:
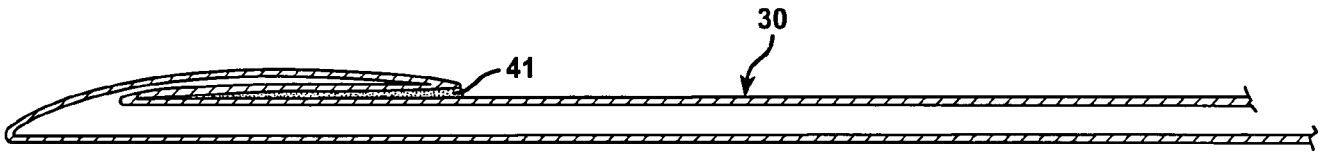
FIG. 4 is an end view of an alternative embodiment of a document binder employed in the present invention, also shown in isolation.

In some cases, however, it may be necessary to stiffen the narrow return panel 38 and binding margin panel 39 further. This can be done by securing the return panel 38 and the binding margin panel 39 together throughout the width of the binding margin 28 in the stack 14. This is most easily accomplished by heat sealing or applying a layer of adhesive 41 between the facing surfaces of the return panel 38 and the portion of the top panel 32 of the document binder 30 above the binding margin 28. This embodiment of the invention is illustrated in FIG. 4 of the drawings. By fastening of the return panel 38 and the portion of the top panel 32 directly therebeneath together by heat sealing, with an adhesive or with some other conventional fastening system, it is highly unlikely that the return panel 38 can be unfolded from atop the top panel 30 by lateral forces acting to separate the clasp 50 from the document binder 30.

Undoubtedly, numerous variations and modifications of the invention will become readily apparent to those familiar with office products. For example, the narrow return panel 38 and the binding margin panel 39 could be formed on the underside of the document binder 30, rather than on top as illustrated. Accordingly, the scope of the invention should not be construed as limited to the specific embodiment depicted and described, but rather is defined in the claims appended hereto.

I claim:

1. In combination, a plurality of sheets of paper disposed one atop another to form a stack having top and bottom sheets and defining a binding edge of said stack, an opposite edge of said stack parallel to said binding edge, and a narrow binding margin on said stack adjacent to said binding edge;

a document binder formed of a single sheet of flat, expansive material, folded to delineate a plurality of panels including a back binding panel located beneath said stack and extending beneath said binding margin, a narrow binding panel joined to said back binding panel and residing above said stack and said narrow binding margin thereof and having a width no greater than the width of said binding margin, a binding return panel joined to said narrow binding panel at a return fold and located beneath said narrow binding panel and projecting from said return fold back toward said binding edge of said stack, and a top binding panel located atop said stack above said top sheet thereof and beneath said binding return panel and delineated therefrom by a margin fold and extending from the proximity of said binding edge of said stack across said top sheet to at least said opposite edge of said stack, wherein said binding return panel has a downwardly facing surface secured throughout to said top binding panel in face-to-face relationship therewith between said return fold and said margin fold; and a stiff, resilient, elongated channel-shaped clasp of uniform cross section throughout formed with a pair of jaws joined together and projecting outwardly from their junction to define a gap therebetween, and at least one of said jaws terminates in a hooked lip, and said binding edge of said stack is inserted into said gap so that said hooked lip is engaged with said document binder at said return fold therein to restrict relative movement between said clasp and said stack in a direction perpendicular to said binding edge, and said clasp has sufficient stiffness so that said jaws clamp said sheets of paper together between said top and back binding panels of said document binder, and said clasp is detachable from said document binder to permit separation of said plurality of said sheets of paper from said binder.

2. A combination according to claim 1 wherein each of said jaws of said clasp terminates in a hooked lip as aforesaid.

3. A combination according to claim 1 wherein said top panel and said return panel are secured together throughout the width of said binding margin in said stack by a layer of adhesive interposed therebetween.

4. A combination according to claim 1 wherein said top panel and said return panel are secured together throughout the width of said binding margin in said stack by heat sealing.

5. In combination, a plurality of pages disposed one atop another to form a stack having top and bottom sheets and defining a binding edge of said stack, an opposite edge of said stack parallel to said binding edge, and a narrow binding margin on said stack adjacent to said binding edge;

a binding for said stack formed of a single, expansive sheet of material and including top and bottom face panels respectively overlying said top and bottom sheets of said stack and joined together by at least one spine fold located at and parallel to said binding edge of said stack, and a narrow margin panel that is joined to said bottom face panel and extends the length of said binding margin and is limited in width so that it extends no further toward said opposite edge of said stack than said binding margin and thereby defines an inboard boundary proximate said binding margin, and a return panel residing between said narrow margin panel and said top face panel and joined to said narrow margin panel by a return fold located at said inboard boundary and joined to said top face panel by a binding edge fold located proximate said binding edge of said stack, wherein said return panel has a downwardly facing surface secured throughout to said top face panel in face-to-face relationship therewith between said return fold and said binding edge fold; and a stiff, resilient, elongated clasp of uniform cross section throughout and formed as a channel-shaped structure having a pair of opposing jaws that have mutually facing surfaces which define a slot opening therebetween, and at least one of said jaws terminates in an inwardly turned hooked lip, and said clasp is disposed to capture said binding therewithin, whereby said hooked lip of said clasp engages said return fold in said binding at said inboard boundary of said narrow margin panel, thereby holding said clasp on said binding edge of said stack, and said jaws are biased toward each other with sufficient force to clamp said plurality of pages together without the necessity of any binding margin fastener through said plurality of pages.

6. A combination according to claim 5 wherein both of said jaws of said clasp are provided with hooked lips, and said hooked lips faced each other across said slot opening.

7. In combination, a plurality of sheets of paper disposed one atop another to form a stack having top and bottom sheets and defining a binding edge of said stack, an opposite edge parallel to said binding edge, and a narrow binding edge margin on said stack adjacent to said binding edge;

a document binder formed of a single sheet of flat material folded to delineate a plurality of panels including a top binding panel located atop said stack and extending from said opposite edge of said stack across said binding margin to terminate at a binding margin fold, a narrow return panel extending from said binding margin fold across said binding margin toward said opposite edge and terminating at a return fold, a narrow binding margin panel located atop said return panel and covering said return panel and extending beyond said binding edge of said stack and terminating at a spine fold, wherein said return panel has an upwardly facing surface residing in contact with said margin panel and a downwardly facing surface residing in contact with and sealed throughout to said top face panel, and a back binding panel joined to said binding margin panel by said spine fold so as to extend beneath said stack and said stack is located between said top and back binding panels;

an elongated document binder clasp configured as a stiff, resilient, channel-shaped structure defining a pair of mutually facing jaws that define a gap therebetween; and wherein at least one of said jaws has a hooked lip, and said binder clasp clamps said plurality of sheets of paper together at said binding edge margin of said stack, and said hooked lip engages said document binder at said return fold throughout the length of said binding margin, whereby said jaws are biased toward each other with sufficient force to clamp said plurality of pages together without the necessity of any binding margin fastener through said plurality of pages.

8. A combination according to claim 7 wherein said downwardly facing surface of said return panel is secured by adhesive to said top face panel throughout the length of said narrow binding margin on said stack.

9. A combination according to claim 7 wherein said downwardly facing surface of said return panel is secured by heat sealing to said top face panel throughout the length of said narrow binding margin on said stack.

* * * * *